US005921248A

United States Patent [19]

Nicholl et al.

[11] Patent Number: 5,921,248

[45] Date of Patent: Jul. 13, 1999

[54] TOBACCO COMBINATION PRODUCT FILTER

[75] Inventors: Iain D. Nicholl, New York, N.Y.; Richard J. Bucala, Cos Cob, Conn.

[73] Assignee: The Picower Institute for Medical Research, Manhasset, N.Y.

[21] Appl. No.: 08/828,416

[22] Filed: Mar. 28, 1997

[51] Int. Cl.[6] ..... A24D 3/10

[52] U.S. Cl. ..... 131/334; 131/331

[58] Field of Search ..... 131/334, 331

[56] References Cited

U.S. PATENT DOCUMENTS

| | | | |
|---|---|---|---|
| 3,693,327 | 9/1972 | Scheinberg | 131/334 X |
| 4,753,250 | 6/1988 | Bitter et al. | 131/334 |
| 5,048,546 | 9/1991 | Hsu et al. | 131/331 |
| 5,060,672 | 10/1991 | Irimi et al. | 131/331 |
| 5,076,294 | 12/1991 | Kramer | 131/331 |
| 5,161,549 | 11/1992 | Rosario | 131/331 |

OTHER PUBLICATIONS

Leffingwell et al. "Tobacco Flavoring For Smoking Products" RJR Tobacco Company, pp. 4–11, Aug. 1972.

*Primary Examiner*—David H. Willse
*Assistant Examiner*—Kelly O'Hara
*Attorney, Agent, or Firm*—Jeffrey B. Oster

[57] ABSTRACT

There are disclosed filters for tobacco combustion products that, when employed in conjunction with exposure to tobacco smoke, inhibit the accumulation of AGEs and AGE-like tobacco- and tobacco smoke-derived adducts in individuals exposed to tobacco smoke. There is further disclosed a use of ascorbic acid and derivatives thereof for the preparation of filters to inhibit the accumulation of advanced glycation endproducts (AGEs) and AGE-like tobacco- and tobacco smoke-derived adducts in individuals exposed to tobacco smoke.

8 Claims, 1 Drawing Sheet

TOBACCO COMBINATION PRODUCT FILTER

TECHNICAL FIELD OF THE INVENTION

The present invention provides filters for tobacco combustion products to inhibit the accumulation of tobacco combustion product-derived adducts on proteins and other biomolecules of tobacco users and of bystanders exposed to tobacco combustion products (tobacco smoke). The present invention further provides a use of ascorbic acid and derivatives thereof in filters to inhibit the accumulation of tobacco- and tobacco smoke-derived adducts in tobacco smokers and in bystanders exposed to tobacco smoke.

BACKGROUND OF THE INVENTION

There have been many studies of the effects of tobacco smoke on human health. There also have been many efforts to determine which of the thousands of components of tobacco smoke have deleterious properties. It remains controversial as to which tobacco components have deleterious health effects, and whether any single tobacco smoke component causes specific health problems. It has recently been established, however, that components of the combustion products of tobacco become covalently attached to proteins that are exposed to tobacco smoke. Further, these tobacco combustion product-derived adducts exhibit physico/chemical properties typical of advanced glycosylation endproducts (or AGEs), which glycation products are the familiar result of the Maillard reaction between proteins and reducing sugars. Moreover, a link between the accumulation of AGEs in vivo and various pathogenic processes with detrimental health consequences has been well established.

Although a sequence of non-enzymatic reactions between proteins and reducing sugars (such as glucose) has been recognized for many years, the biological and physiological consequences of such reactions and the products of this reaction sequence are still under investigation. The earliest recognized manifestation of non-enzymatic protein glycosylation (or glycation) was the appearance of brown pigments during long-term storage or cooking of food. This non-enzymatic browning reaction was identified by Maillard in 1912. Maillard observed that glucose or other reducing sugars react spontaneously with amino-containing compounds, such as amino acids and peptides, to form initial Schiff base adducts which can rearrange to generate the Amadori and Heyns products. These initial condensation products then undergo a series of additional spontaneous dehydrations, rearrangements and other reactions to form more advanced glycosylation endproducts, or AGEs. This reaction sequence has come to be known alternatively as the Maillard reaction, non-enzymatic browning, advanced glycosylation or glycation.

As a class, AGEs formed through the Maillard reaction are yellow/brown in color, exhibit a characteristic absorption/emission profile, have protein cross-linking activity, share immunological determinants, and have deleterious consequences as they accumulate in vivo.

The non-enzymatic rearrangement of the initial Schiff base formed by addition of glucose to a free amino group on a protein forms a stable amino, 1-deoxy ketosyl adduct known as an Amadori product. A parallel reaction involving a reducing ketose rather than an aldose generates an early glycation product known as the Heyns rearrangement product. Accumulation of these early glycation adducts can occur, for instance, with hemoglobin wherein rearrangement of the amino terminus of the β-chain follows an initial reaction with glucose to form hemoglobin $A_{1c}$, an important marker of glucose control in diabetes. Glycation reactions have also been found to occur with other body proteins, such as lens crystallins, collagen nerve proteins, and low density lipoproteins, as well as with DNA and aminophospholipids.

The Maillard browning process generates a diverse array of AGEs, each species of which occurs in low abundance. This diversity has complicated the identification and structural determination of specific AGEs. U.S. Pat. No. 4,665,192 identifies the fluorescent chromophore known as FFI, and a few other AGEs, such as AFGP (U.S. Pat. No. 5,017,696), pyrraline (Hayase et al., *J. Biol. Chem.* 263:3757–3764, 1989), and pentosidine (Sell and Monnier, *J. Biol. Chem.* 264:21597–21602, 1989) have also been identified.

Maillard reaction products have been shown to underlie a wide variety of both normal and pathogenic activities and responses that occur as AGEs accumulate on proteins in vivo. In addition, the non-enzymatic glycosylation of other biomolecules, such as the formation of AGEs on lipids and on lipid-containing particles, may also contribute to pathogenesis. Such lipid-AGEs, for instance, are thought to play a pathogenic role in atherogenesis, where formation of lipid-laden foam cells marks the initiation of atherosclerotic plaques. Glycation and oxidation of protein and lipid components of low-density lipoprotein (LDL) results in a loss of recognition of the apo B component by cellular LDL receptors, prolonging the circulating half-life of AGE-modified LDL and resulting in a preferential uptake of modified LDL, such as AGE-LDL and oxidized LDL , by "scavenger receptors," by AGE receptors and by other specialized cellular mechanisms. The enhanced endocytosis of modified LDL by vascular wall macrophages has been linked to their transformation into lipid-laden foam cells that characterize early atherosclerotic lesions. Other studies have demonstrated that AGE formation on DNA has mutagenic consequences.

U.S. patent application Ser. No. 08,772,335 filed Dec. 23, 1996, the disclosure of which is incorporated by reference herein, shows that exposure of proteins to tobacco extracts or to tobacco smoke or to extracts of tobacco combustion products leads to the accumulation on the proteins of covalently attached adducts. As a group, these tobacco- and tobacco smoke-derived adducts exhibit a physico/chemical profile that suggests significant structural overlap with the AGEs of the Maillard reaction. Like glycation-derived AGEs, tobacco- and tobacco smoke-derived adducts, as a group:

(a) are yellow/brown in color;

(b) exhibit a characteristic absorption/emission profile (fluorescence at 440 nm upon excitation at 370 nm);

(c) have protein cross-linking activity; and, (d) share immunological cross-reactivity with antibodies raised against and specific for AGEs formed by the Maillard reaction.

Furthermore, tobacco smokers and animals experimentally exposed to tobacco smoke accumulate adducts with the above physico/chemical characteristics of glycation-derived AGEs. Therefore, there is a need in the art to find compounds that can inhibit or prevent, in the users of tobacco or in those otherwise exposed to tobacco smoke, the accumulation of AGEs or AGE-like tobacco- or tobacco smoke-derived adducts.

Although the Ser. No. 08,772,335 patent application provides a limited number of agents to inhibit the accumulation of AGEs in persons exposed to tobacco smoke, there is a further need in the art to find additional products that can inhibit the accumulation of AGEs and/or AGE-like tobacco- or tobacco smoke-derived adducts in persons exposed to tobacco smoke, and in particular to provide such alternative products that are more effective inhibitors or exhibit fewer undesired side-effects than the agents of the Ser. No. 08,772,335 application.

SUMMARY OF INVENTION

The present invention provides a filter formulation for use with combustible tobacco products and extracts thereof, comprising an ascorbic acid compound from formula I:

I

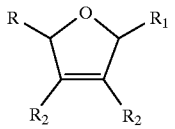

wherein R is —$CH_2OH$, —CHOH—$CH_2OH$, —CHOH—CHOH—$CH_2OH$, —$CH_2$—CHOH—$CH_2OH$, —CHOH—CHOH—CHOH—$CH_2OH$, $CH_2$—$CH_2$—CHOH—$CH_2OH$, —COOH, —CHOH—COOH, —CHOH—CHOH—COOH,—$CH_2$—CHOH—COOH, —CHOH—CHOH—CHOH—COOH, or $CH_2$—$CH_2$—CHOH—COOH; wherein $R_1$is =O, Cl, Br, F, or I, and wherein $R_2$ is independently hydroxy, keto, or $C_{1-6}$ alkoxy; contained within a filter matrix. Preferably, the ascorbic acid compound of formula I is ascorbic acid. Preferably, the filter matrix is primarily cellulose acetate.

The present invention further provides a method for inhibiting the accumulation of AGEs and/or AGE-like tobacco- or tobacco smoke-derived adducts in persons exposed to tobacco smoke, comprising providing a filter formulation containing an ascorbic acid compound from formula I contained within a filter matrix, and filtering the tobacco combustion products or liquid tobacco extract through the formulated filter. Preferably, the ascorbic acid compound of formula I is ascorbic acid. Preferably, the filter matrix is primarily cellulose acetate.

DETAILED DESCRIPTION OF THE INVENTION

Figure 1:
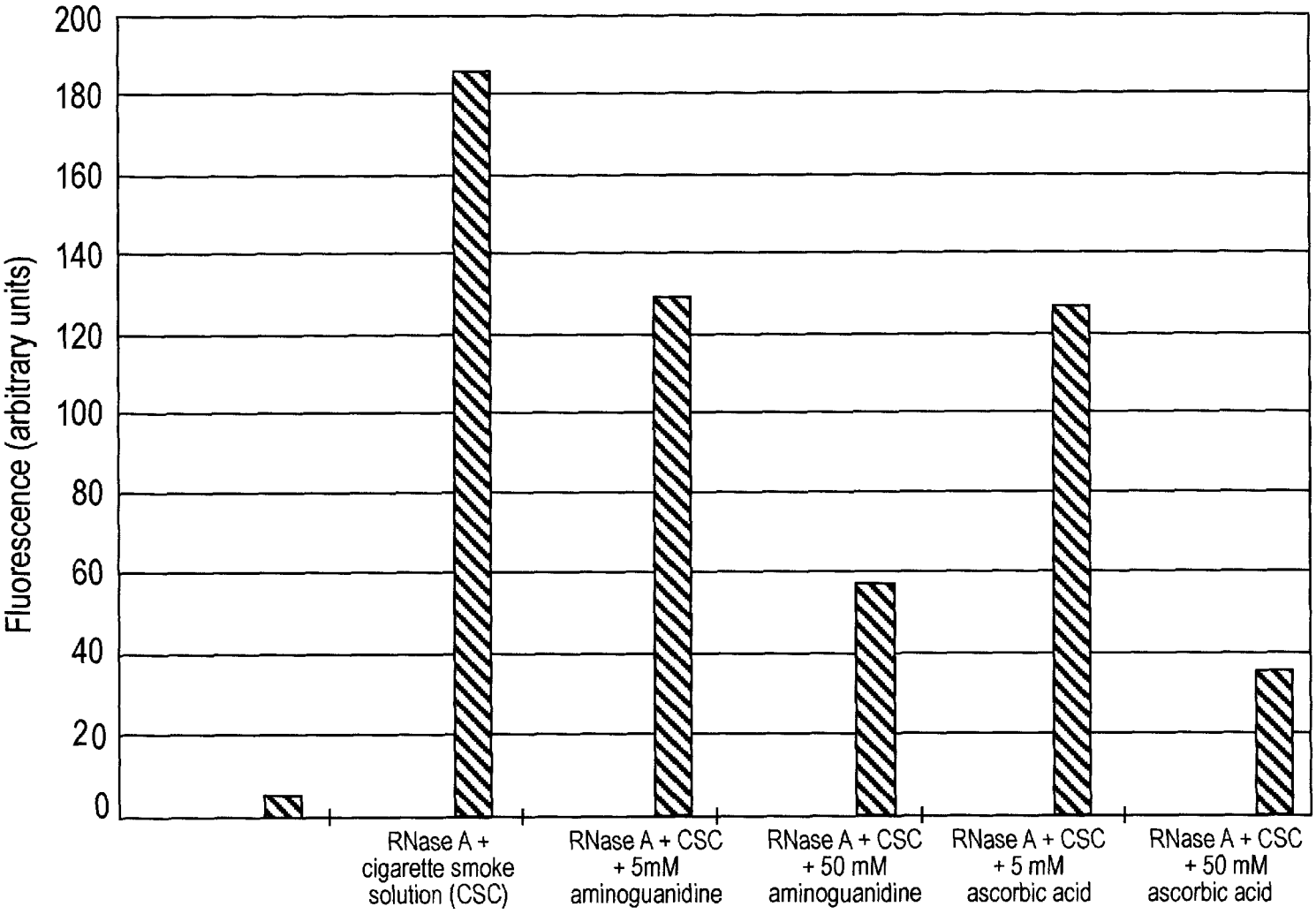
FIG. 1 shows a bar graph comparing the inhibitory activity 5 and 50 mM aminoguanidine solutions versus 5 and 50 mM of ascorbic acid solutions on the accumulation of AGEs and/or AGE-like tobacco- or tobacco smoke-derived adducts with the characteristic absorption emission profile of glycation-derived AGEs. These data show a concentration-dependent inhibitory effect on such accumulation by both aminoguanidine and ascorbic acid, with ascorbic acid exhibiting somewhat greater activity on a molar basis.

The present invention provides a filter formulation for use in connection with the combustion tobacco products or tobacco extract products, comprising an ascorbic acid compound from formula I:

I

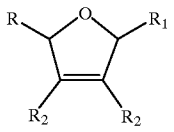

wherein R is —$CH_2OH$, —CHOH—$CH_2OH$, —CHOH—CHOH—$CH_2OH$, —$CH_2$—CHOH—$CH_2OH$, —CHOH—CHOH—CHOH—$CH_2OH$, $CH_2$—$CH_2$—CHOH—$CH_2OH$, —COOH, —CHOH—COOH, —CHOH—CHOH—COOH, —$CH_2$—CHOH—COOH, —CHOH—CHOH—CHOH—COOH, or $CH_2$—$CH_2$—CHOH—COOH; wherein $R_1$ is =O, Cl, Br, F, or I, and wherein $R_2$ is independently hydroxy, keto, or $C_{1-6}$ alkoxy; contained within a filter matrix. Preferably, the ascorbic acid compound of formula I is ascorbic acid. Preferably, the filter matrix is primarily cellulose acetate.

Filter materials for tobacco combustion products (tobacco smoke) can be made by providing a concentrated solution of a compound of formula I in a solvent (e.g., aqueous, shorter chain alcohol), immersing a filter for tobacco products in the concentrated solution, and then drying the filter. The tobacco combustion product filters are made from materials frequently used for cigarette filters, and are, preferably, cellulosic materials. The cellulose-based tobacco smoke filters are those used in the tobacco industry and, preferably, fabricated for use in cigarettes. Cigarette filters are often fibrous material bundled together and bound into a cylindrical form. Most preferably, the filter is made from cellulose acetate impregnated with from 1% to 20% by weight of a compound from formula I. In addition the filter can be made from a polyester material, such as poly (ethylene terephthalate).

The filters are made by impregnating the filter materials with a compound from formula I. The step of impregnation may be accomplished, for example, by immersing the filter material in a concentrated solution of a compound from formula I, followed by drying the filter material. The present invention is made by providing a concentrated aqueous solution of a compound of formula I, preferably ascorbic acid, that is applied in sufficient quantity to a filter element for a tobacco product filter (e.g., a cigarette filter, cigar filter or pipe filter) or for an air filter for treating ambient or "second-hand" tobacco smoke. A quantity of the compound is dissolved in an aqueous solvent, preferably distilled water, and the solution stirred until a uniform solution is maintained. The concentration of the compound from formula I ranges from about 5% w/v to about 100% w/v. The filter element used is characteristically composed of a fibrous filament material made from cellulose acetate, regenerated cellulose, paper, cotton, nylon, rayon, gauze, polyolefins, such as polypropylene, polyvinylidine chloride, polyethylene, polystyrene, and various combinations thereof. Any material used to make the filter element of tobacco smoke filters can be used to practice this invention. Preferably, the filter element is made from cellulose acetate. If the fibrous material is coated with a plasticizer, the fibrous material, preferably, is deplasticized or degreased to remove any oils, fats, waxes or other coating from the fibrous material. The fibrous material is then formed into compact structures, according to standard methods practiced, for instance, in the cigarette industry, such as bundles of desired length and diameter to be used as filter elements in tobacco smoke filters for cigarettes, pipes or any device used to smoke tobacco or as filter elements to filter smoke-laden air.

After forming the filter elements, the filters are placed in a suitable centrifuge to remove any water retained by the fibrous filaments from the degreasing or deplasticizing operation. The filters are then further air dried to dry out the filters at appropriate temperatures and conditions to insure dryness. The dried filters are treated with the solutions of the compound of formula I. The solution can be sprayed onto the filter or the filter can be dipped into the solution or the solution can be applied to the filter by any suitable means. A sufficient amount of the solution is applied such that the entire filter is saturated with the solution. After drying, the filter element is joined with the appropriate tobacco product, such as a cigarette, or otherwise incorporated into a filtration device for smoke-laden air.

The present invention further provides a method for inhibiting the accumulation of AGEs or AGE-like tobacco smoke-derived adducts on proteins in tobacco smokers or bystanders exposed to tobacco smoke, comprising providing a filter formulation containing an ascorbic acid compound from formula I contained within or impregnated in a filter-based matrix (preferably, a cellulosic filter matrix), and filtering the tobacco combustion products or smoke through the filter formulation. Preferably, the ascorbic acid compound is ascorbic acid. Preferably, the filter-based matrix is primarily cellulose acetate. It is desirable to inhibit the accumulation of such AGEs and AGE-like tobacco- and tobacco smoke-derived adducts because of mounting evidence of accelerated aging and the appearance of aging properties in persons exposed to tobacco smoke in the long-term. For example, a well-documented phenomenon called "smoker's face" is a highly colored and wrinkled appearance in the face and extremities (e.g., hands) of longer term smokers that is easily noticeable and documented and is likely caused by excessive accumulation over time of AGEs and AGE-like tobacco- and tobacco smoke-derived adducts. Therefore, it is desirable to address this undesired consequence of exposure to tobacco smoke with an inventive filter. Moreover, the present invention further encompasses other filter products that filter ambient air to inhibit the accumulation of AGEs and AGE-like tobacco- and tobacco smoke-derived adducts resulting from exposure to ambient or "second-hand" smoke, particularly in indoor environments.

EXAMPLE 1

This example illustrates a controlled experiment wherein ascorbic acid was compared to aminoguanidine for their inhibitory activity with respect to the accumulation of AGEs and AGE-like tobacco- and tobacco smoke-derived adducts from tobacco smoke, in this case the tobacco combustion products of cigarette smoke. Bovine pancreatic ribonuclease A (RNase A) was obtained from Boehringer Mannheim, and ascorbic acid was obtained from Sigma Chemical Co. Aminoguanidine was synthesized.

An RNase A modification-mainstream cigarette smoke "solution" was prepared in the following way: 2 mL of a PBS/2 mM EDTA solution was placed in a 25 mL glass Erlenmeyer flask and an unlit cigarette put into a 1000 $\mu$l pipette tip inserted in a septum sealing the glass flask. The tip of the pipette tip did not penetrate the aqueous solution. The cigarette was lit after a vacuum was applied to the flask, such that mainstream tobacco smoke was drawn into the airspace contacting the PBS/EDTA solution, resulting in the transfer of tobacco combustion products from the smoke to the solution. The resulting "smoked" PBS/2 mM EDTA solution was then filtered through a 0.45 $\mu$m Millex-HA filter unit (Millipore, Bedford, Mass.) prior to further use. The filtered "smoked" PBS/EDTA solution was contacted with RNase A protein dissolved in PBS/2 mM EDTA in a combined solution additionally containing either 0, 5 or 50 mM aminoguanidine or 0, 5 or 50 mM ascorbic acid. An amount of the "smoked" PBS/EDTA solution exposed to the equivalent of the smoke of 1 cigarette was incubated with 5 mg RNase A as described above. Incubation was performed under sterile conditions, in the dark, and at 37° C. for 22 hours. Unbound low molecular weight materials from the "smoked" solutions and from the treatment solutions were separated from the exposed protein samples by extensive dialysis against PBS/2 mM EDTA solution or by ultrafiltration using Centricon 10 centrifugal concentrators (Amicon; Beverly, Mass.).

The accumulation of AGEs and AGE-like tobacco- or tobacco smoke-derived adducts on the protein samples was measured as a function of the characteristic AGE absorbance/emission (fluorescence) profile measured at 440 nm upon excitation at 370 nm. Protein concentration was estimated using a Micro BCA protein assay reagent kit (Pierce) utilizing RNase A as a standard. AGE-characteristic fluorescence determinations were performed by measuring emission at 440 nm upon excitation at 370 nm using a LS 50B fluorescence spectrometer (Perkin-Elmer). Fluorescence values were measured at a protein concentration of 0.5 mg/ml in PBS/2 mM EDTA solution.

The results are provided in FIG. 1. These data show that both aminoguanidine and ascorbic acid can inhibit, in a concentration-dependent fashion, the accumulation of AGEs and AGE-like tobacco- and tobacco smoke-derived adducts on proteins exposed to tobacco combustion products. On a comparative basis, ascorbic acid showed greater molar potency than aminoguanidine. Accordingly, these data provide predictive results in an appropriate experimental model to provide evidence of efficacy for the inventive filters to effectively inhibit the accumulation of AGEs and AGE-like tobacco- and tobacco smoke-derived adducts on proteins exposed to tobacco combustion products.

We claim:

1. A tobacco filter element for use with combustion tobacco products for filtering tobacco smoke-laden air comprising compound of formula I:

I

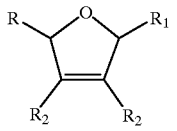

wherein R is —$CH_2OH$, —CHOH—$CH_2OH$, —CHOH—CHOH—$CH_2OH$, —$CH_2$—CHOH—$CH_2OH$, —CHOH—CHOH—CHOH—$CH_2OH$, —$CH_2$—$CH_2$—CHOH—$CH_2OH$, —CHOH—COOH, —CHOH—CHOH—COOH, —$CH_2$—CHOH—COOH, —CHOH—CHOH—CHOH—COOH, or —$CH_2$—$CH_2$—CHOH—COOH; wherein $R_1$ is =O, Cl, Br, F or I, and wherein $R_2$ is independently hydroxy, keto or $C_{1-6}$ alkoxy; and a tobacco filter, wherein the compound of formula I is impregnated within the tobacco filter.

2. The tobacco filter element of claim 1 wherein the filter element is made from a cellulose-based material.

3. The tobacco filter element of claim 2 wherein the cellulose-based material is cellulose acetate.

4. The tobacco filter element of claim 1 wherein the filter element is made from polyester or polypropylene.

5. A method for inhibiting the accumulation of advanced glycation endproducts (AGEs) and AGE-like tobacco- and tobacco smoke-derived adducts in individuals exposed to tobacco smoke, comprising providing a tobacco filter element having a compound from formula I:

I

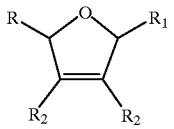

wherein R is —$CH_2OH$, —CHOH—$CH_2OH$, —CHOH—CHOH—$CH_2OH$, —$CH_2$—CHOH—$CH_2OH$, —CHOH—CHOH—CHOH—$CH_2OH$, —$CH_2$—$CH_2$—CHOH—$CH_2OH$, —CHOH—COOH, —CHOH—CHOH—COOH, —$CH_2$—CHOH—COOH, —CHOH—CHOH—CHOH—COOH, or —$CH_2$—$CH_2$—CHOH—COOH; wherein $R_1$ is =O, Cl, Br, F or I, and wherein $R_2$ is independently hydroxy, keto or $C_{1-6}$ alkoxy; impregnated within a filter matrix, and filtering the tobacco combustion products through the tobacco filter element.

6. The method of claim 5, wherein the filter element is a cellulose.

7. The method of claim 6, wherein the filter element is a cellulose acetate.

8. The method of claim 5, wherein the filter element is a polyester .

* * * * *